US011533555B1

(12) United States Patent
Ganeshkumar

(10) Patent No.: US 11,533,555 B1
(45) Date of Patent: Dec. 20, 2022

(54) WEARABLE AUDIO DEVICE WITH ENHANCED VOICE PICK-UP

(71) Applicant: Bose Corporation, Framingham, MA (US)

(72) Inventor: Alaganandan Ganeshkumar, North Attleboro, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 17/369,049

(22) Filed: Jul. 7, 2021

(51) Int. Cl.
*G10L 25/81* (2013.01)
*H04R 1/10* (2006.01)
*H04R 1/40* (2006.01)

(52) U.S. Cl.
CPC ..... *H04R 1/1083* (2013.01); *G10L 25/81* (2013.01); *H04R 1/406* (2013.01); *H04R 2460/01* (2013.01)

(58) Field of Classification Search
CPC .. H04R 1/1083; H04R 1/406; H04R 2460/01; G10L 25/81
USPC ..... 381/71.6
See application file for complete search history.

(56) References Cited

U.S. PATENT DOCUMENTS

2005/0000816 A1 1/2005 Gleissner et al.
2009/0001654 A1 1/2009 Goldstein et al.
2014/0044274 A1* 2/2014 Ebenezer ..... H04R 3/005 381/71.4
2018/0343514 A1* 11/2018 Dusan ..... H04R 1/1083
2019/0304427 A1 10/2019 Kemmerer et al.
2019/0378491 A1* 12/2019 Mohammad ..... G10K 11/17823
2022/0060812 A1 2/2022 Ganeshkumar
2022/0070593 A1* 3/2022 Riemer ..... G06F 3/165
2022/0132245 A1* 4/2022 Klimanis ..... H04R 3/005
2022/0189497 A1* 6/2022 Rui ..... G10L 21/0216

OTHER PUBLICATIONS

PCT International Search Report and Written Opinion for International Application No. PCT/US2022/036283, dated Oct. 13, 2022, 11 pages.

* cited by examiner

*Primary Examiner* — Vivian C Chin
*Assistant Examiner* — Friedrich Fahnert
(74) *Attorney, Agent, or Firm* — Hollman Warnick LLC

(57) ABSTRACT

Various implementations include systems for processing microphone audio signals for a wearable audio device. In particular implementations, a method for processing signals includes: capturing an internal signal with an inner microphone configured to be acoustically coupled to an environment inside an ear canal of a user; extracting a low frequency audio signal from the internal signal; capturing an external signal with an external microphone configured to be acoustically coupled to an environment outside the ear canal of the user; extracting a high frequency audio signal from the external signal; and mixing the high frequency audio signal with the low frequency audio signal.

20 Claims, 3 Drawing Sheets

WEARABLE AUDIO DEVICE WITH ENHANCED VOICE PICK-UP

TECHNICAL FIELD

This disclosure generally relates to wearable audio devices. More particularly, the disclosure relates to wearable audio devices that enhance the user's speech signal.

BACKGROUND

Wearable audio devices such as headphones commonly provide for two-way communication, in which the device can both output audio and capture user speech signals. To capture speech, one or more microphones are generally located somewhere on the device. Depending on the form factor of the wearable audio device, different types and arrangements of microphones may be utilized. For example, in over-ear headphones, a boom microphone may be deployed that sits near the user's mouth. In other cases, such as with in-ear devices, microphones may be integrated within an earbud proximate the user's ear. Because the location of the microphone is farther away from the user's mouth with in-ear devices, accurately capturing user voice signals can be more challenging.

SUMMARY

All examples and features mentioned below can be combined in any technically possible way.

Systems and approaches are disclosed that adaptively enhance a user's speech (i.e., voice) pick-up on a wearable audio device. Some implementations include a method for processing signals for a wearable audio device that includes: capturing an internal signal with an inner microphone configured to be acoustically coupled to an environment inside an ear canal of a user; extracting a low frequency audio signal from the internal signal; capturing an external signal with an external microphone configured to be acoustically coupled to an environment outside the ear canal of the user; extracting a high frequency audio signal from the external signal; and mixing the high frequency audio signal with the low frequency audio signal.

In additional particular implementations, a wearable audio device is provided that includes: at least one microphone and a processor coupled to the at least one microphone. The processor is configured to: capture an internal signal with an inner microphone configured to be acoustically coupled to an environment inside an ear canal of a user; extract a low frequency audio signal from the internal signal; capture an external signal with an external microphone configured to be acoustically coupled to an environment outside the ear canal of the user; extract a high frequency audio signal from the external signal; and mix the high frequency audio signal with the low frequency audio signal.

Implementations may include one of the following features, or any combination thereof.

In some cases, extracting the high frequency audio signal from the external signal includes using the internal signal to filter the external signal.

In particular implementations, using the internal signal to filter the external signal includes calculating filter coefficients from the internal signal during non-speech activity.

In some cases, the internal signal is captured with an internal feedback microphone.

In certain aspects, extracting the low frequency audio signal from the internal signal includes using the external signal to filter the internal signal.

In some implementations, using the external signal to filter the internal signal includes calculating filter coefficients from the external signal during non-speech activity.

In various cases, the external signal is captured with a null former that adaptively cancels noise based on sounds captured from a further external microphone during non-speech activity.

In certain cases, mixing the high frequency audio signal with the low frequency audio signal includes: detecting a noise level proximate the wearable audio device; and selecting a mixing strategy based on the noise level.

In some cases, the noise level is detected with at least one of a microphone or a voice activity detector.

In other cases, a beamformer captures and processes sounds from an array of external microphones.

In certain implementations, extracting the high frequency audio signal, extracting the low frequency audio signal, and mixing the high frequency audio signal with the low frequency audio signal are processed in a frequency domain.

Two or more features described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

Figure 1:
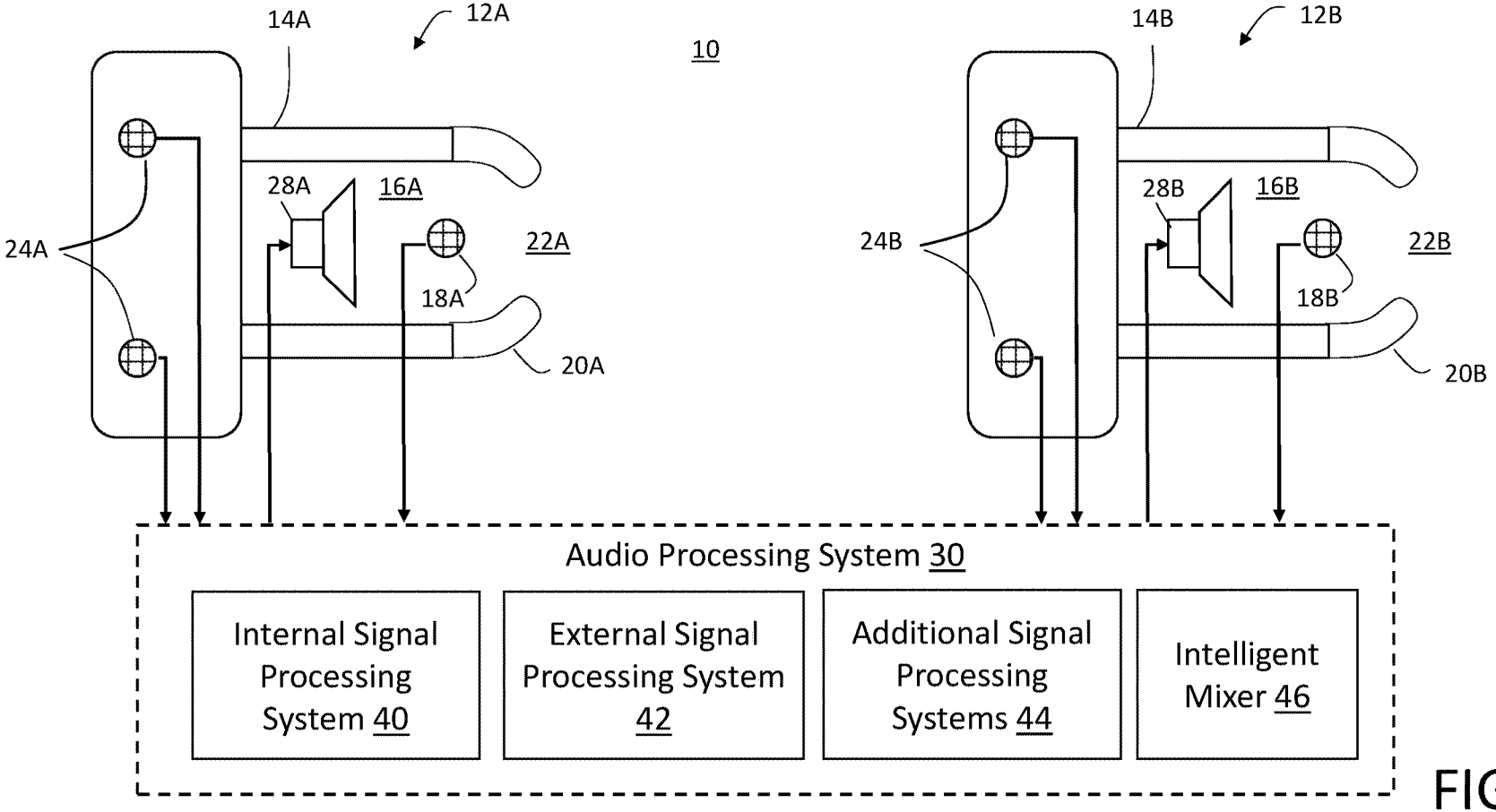
FIG. 1 is a block diagram depicting an example wearable audio device according to various disclosed implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that an internal signal captured from an inner microphone within an in-ear wearable audio device (e.g., an earbud) can be adaptively processed and utilized for communicating the user's voice when external environmental noise exists. An example of this system was disclosed in U.S. patent application Ser. No. 16/999,353 filed on Aug. 21, 2020, entitled "WEARABLE AUDIO DEVICE WITH INNER MICROPHONE ADAPTIVE NOISE REDUCTION," which is hereby incorporated by reference. However, in such an arrangement, the inner microphone voice pick-up may have limited audible high frequency cues. Accordingly, while such a system can provide intelligible speech in challenging noise conditions, the perceived sound quality can be less than ideal, i.e., the user's voice may sound muffled.

In certain aspects, the present disclosure addresses the aforementioned issue, as well as others, by using the available internal and external microphones in an earbud system to extract and mix in high frequency components. Experiments performed by the inventors of the present disclosure have shown that a high frequency extracted signal modulated with the actual speech signal is sufficient to produce a more overall natural, intelligible and pleasing wider band speech signal when combined with the low frequency output of the previous system. This enhanced signal can be achieved even though the high frequency extracted signal is not necessarily intelligible. The technical result is a system that is low complexity, low cost and can be readily implementable in a battery powered wearable platform.

Aspects and implementations disclosed herein may be applicable to a wide variety of wearable audio devices in various form factors, but are generally directed to devices having at least one inner microphone that is substantially shielded from environmental noise (i.e., acoustically coupled to an environment inside the ear canal of the user) and at least one external microphone substantially exposed to environmental noise (i.e., acoustically coupled to an environment outside the ear canal of the user). Further, various implementations are directed to wearable audio devices that support two-way communications, and may for example include in-ear devices, over-ear devices, and near-ear devices. Form factors may include, e.g., earbuds, headphones, hearing assist devices, and other wearables. Further configurations may include headphones with either one or two earpieces, over-the-head headphones, behind-the neck headphones, in-the-ear or behind-the-ear hearing aids, wireless headsets (i.e., earsets), audio eyeglasses, single earphones or pairs of earphones, as well as hats, helmets, clothing or any other physical configuration incorporating one or two earpieces to enable audio communications and/or ear protection. Further, what is disclosed herein is applicable to wearable audio devices that are wirelessly connected to other devices, that are connected to other devices through electrically and/or optically conductive cabling, or that are not connected to any other device, at all.

It should be noted that although specific implementations of wearable audio devices are presented with some degree of detail, such presentations of specific implementations are intended to facilitate understanding through provision of examples and should not be taken as limiting either the scope of disclosure or the scope of claim coverage.

FIG. 1 is a block diagram of an example of an in-ear wearable audio device 10 having two earpieces 12A and 12B, each configured to direct sound towards an ear of a user. (Reference numbers appended with an "A" or a "B" indicate a correspondence of the identified feature with a particular one of the two earpieces. The letter indicators are however omitted from the following discussion for simplicity, e.g., earpiece 12 refers to either or both earpiece 12A and earpiece 12B.) Each earpiece 12 includes a casing 14 that defines a cavity 16 that contains an electroacoustic transducer 28 for outputting audio signals to the user. In addition, at least one inner microphone 18 is also disposed within cavity 16. In implementations where wearable audio device 10 is ear-mountable, an ear coupling 20 (e.g., an ear tip or ear cushion) attached to the casing 14 surrounds an opening to the cavity 16. A passage 22 is formed through the ear coupling 20 and communicates with the opening to the cavity 16. In various implementations, one or more external microphones 24 are disposed on the casing in a manner that permits acoustic coupling to the environment external to the casing 12.

Audio output by the transducer 28 and speech capture by the microphones 18, 24 within each earpiece is controlled by an audio processing system 30. Audio processing system 30 may be integrated into one or both earpieces 12 or be implemented by an external system. In the case where audio processing system 30 is implemented by an external system, each earpiece 12 may be coupled to the audio processing system 30 either in a wired or wireless configuration. In various implementations, audio processing system 30 may include hardware, firmware and/or software to provide various features to support operations of the wearable audio device 10, including, e.g., providing a power source, amplification, input/output, network interfacing, user control functions, active noise reduction (ANR), signal processing, data storage, data processing, voice detection, etc.

Audio processing system 30 can also include a sensor system for detecting one or more conditions of the environment proximate personal audio device 10. Such a sensor system, e.g., ensures that adapting the system is minimized in case the main voice activity detection (VAD) system has false negatives (e.g., the user is not talking loud enough, etc.). A sensor system by itself may not be reliable for VAD, but if the sensor system outputs activity that might indicate suspicion of voice activity along with a lower threshold VAD activity, adapting to minimize coefficient corruption can be avoided.

In implementations that include ANR for enhancing audio signals, the inner microphone 18 may serve as a feedback microphone and the external microphones 24 may serve as feedforward microphones. In such implementations, each earphone 12 may utilize an ANR circuit that is in communication with the inner and external microphones 18 and 24. The ANR circuit receives an internal signal generated by the inner microphone 18 and an external signal generated by the external microphones 24 and performs an ANR process for the corresponding earpiece 12. The process includes providing a signal to an electroacoustic transducer (e.g., speaker) 28 disposed in the cavity 16 to generate an anti-noise acoustic signal that reduces or substantially prevents sound from one or more acoustic noise sources that are external to the earphone 12 from being heard by the user.

As noted, in addition to outputting audio signals, wearable audio device 10 is configured to provide two-way communications in which the user's voice or speech is captured and then outputted to an external node via the audio processing system 20. Various challenges may exist when attempting to capture the user's voice in an arrangement such as that shown in FIG. 1. For instance, the external microphones 24 are susceptible to picking up environmental noise and wind, which interferes with the user's speech. While an internal signal captured by the inner microphone 18 is not subject to environmental interference, speech coupled to the inner microphone 18 is primarily via bone conduction due to occlusion. As such, the naturalness of the voice picked up by the inner microphone 18 is limited and the useable bandwidth is approximately no more than 2 KHz (i.e., a substantially low frequency audio signal).

In certain implementations, the low frequency audio signal may be enhanced (e.g., noise reduced) with an internal signal processing system 40 that adaptively adjusts the internal signal based on an external signal captured by an external microphone 24 during non-speech activity. In one approach, the internal signal processing system 40 calculates noise reduction parameters (i.e., filter coefficients) based on the external signal, and applies the parameters to the internal signal to filter and generate the noise reduced internal signal. In certain embodiments, internal signal processing system 40 identifies when non-speech activity occurs based, e.g., on inputs from a VAD. During such periods when no speech signal is detected, a filter coefficient calculator analyzes the external signal to adaptively determine filter coefficients that will cancel any external acoustic noise from the internal signal. The filter coefficients can be calculated adaptively using any well-known adaptive algorithms such the normalized least means square (NLMS) algorithm. The coefficients represent the feedforward path or transfer function between the external microphone 24 and the internal microphone 18. In some cases, internal signal processing can be preloaded with selectable coefficients to enable faster adaptation.

Whenever the non-speech activity ends, e.g., the VAD identifies speech activity of the user, the currently calculated coefficients are captured, which are then applied to the internal signal to eliminate external noise. When the user is no longer speaking and a new non-speech period begins, e.g., as indicated by the VAD, the current set of noise cancellation filter coefficients is discarded and new sets of noise cancellation filter coefficients are recalculated in response to the external signal. This process provides an enhanced low frequency audio signal when the user speaks, which is audible to the listener.

As noted herein, aspects of this disclosure add an extracted high frequency component to the low frequency audio signal to improve audibility. In various implementations, an external signal processing system 42 is deployed to extract a high frequency audio signal from an external signal (e.g., captured by external microphone 24), which is then combined with the low frequency audio signal using intelligent mixer 46. In certain embodiments, the external signal processing system 42 adaptively adjusts the external signal using the internal signal as a noise reference in a similar (but opposite) manner as the internal signal processing system 40. Namely, during non-speech activity periods, the external signal processing system 42 calculates noise reduction parameters (i.e., filter coefficients) based on the internal signal. Whenever the non-speech activity ends, e.g., a VAD identifies speech activity of the user, the currently calculated coefficients are captured, which are then applied to the external signal to filter and eliminate noise. When the user is no longer speaking and a new non-speech period begins, e.g., as indicated by the VAD, the current set of noise cancellation filter coefficients is discarded and new sets of noise cancellation filter coefficients are recalculated in response to the internal signal.

As described in further detail herein, one or more additional signal processing systems 44 may also be utilized to capture and process the voice signal of the user. These processed signals can also be fed to the intelligent mixer 46, which can selectively mix signals based on environmental conditions (e.g., noise levels and wind levels), user preferences, etc.

Figure 2:
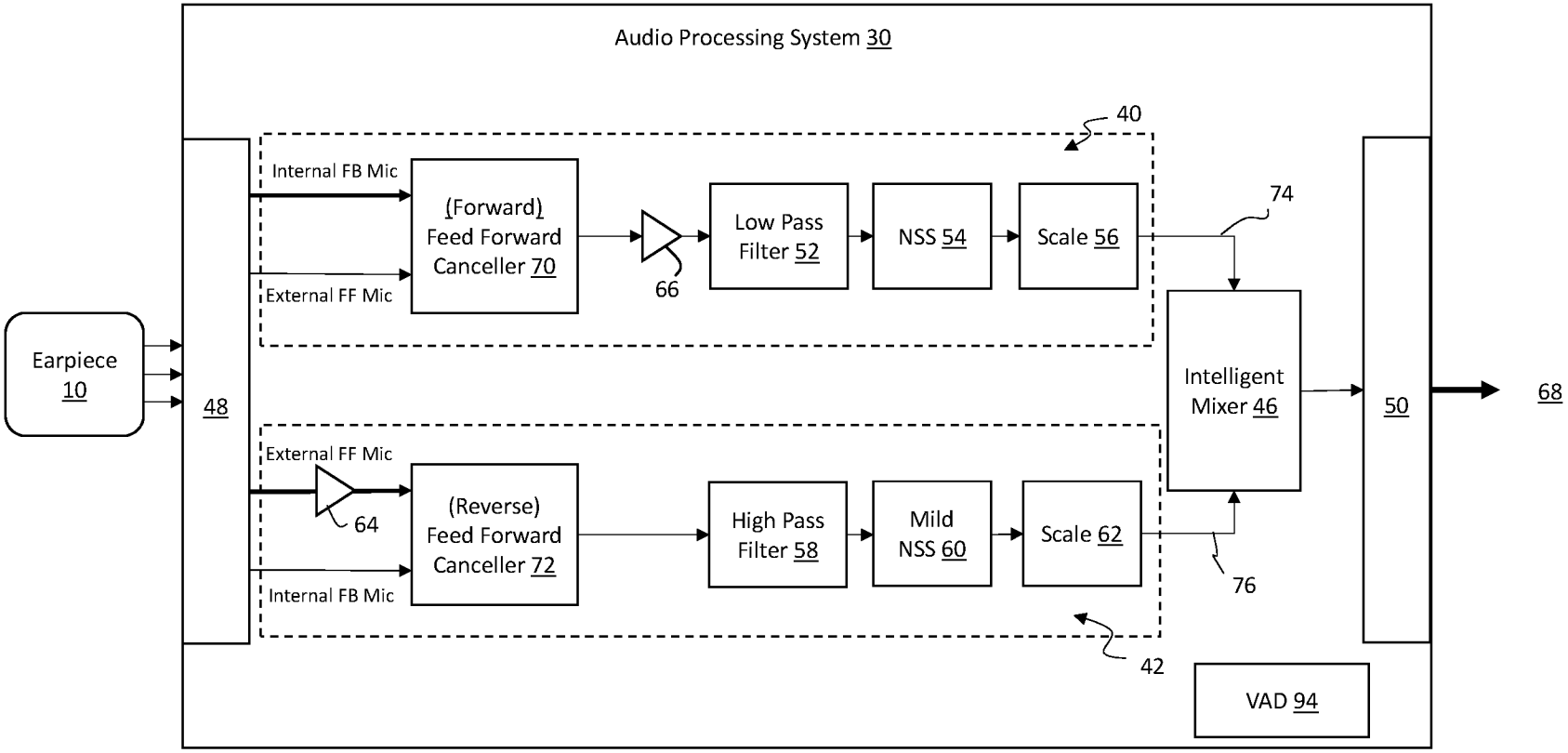
FIG. 2 is a block diagram depicting an audio processing system according to various implementations.

FIG. 2 depicts an illustrative embodiment of audio processing system 30 that receives speech and other inputs from a set of microphones on earpiece 10, processes the inputs, and outputs an enhanced speech signal 68 for transmission or further processing. In this embodiment, earpiece 10 is configured to capture at least one external signal, in this example from an external feed forward (FF) microphone and at least one internal signal, in this example from an internal feedback (FB) microphone. System 30 generally includes: a domain converter 48 that converts microphone signals from the time (i.e., acoustic) domain to the frequency (i.e., electrical) domain; an internal signal processing system 40; an external signal processing system 42; an intelligent mixer 46; and an inverse domain converter 50 that generates a time domain output signal (i.e., enhanced speech signal 68). Domain converter 48 may for example be configured to convert the time domain signal into 64 or 128 frequency bands using a four channel weighted overlap add (WOLA) analysis, and inverse domain converter 50 may be configured to perform the opposite function. In some implementations, additional functionality and output stage processing features may be included, e.g., a VAD, a speech equalizer, a short-time spectral amplitude (STSA) speech enhancement system, etc., to further enhance the enhanced speech signal 68.

In some implementations, internal signal processing system 40 utilizes an adaptive (forward) feed forward canceller 70 similar in principal to how a feed forward ANR system functions. In the depicted implementation, the canceller 70 operates in the frequency (i.e., electrical) domain and hence can in-situ (accounting for fit variations) cancel noise to very low levels relative to what would be possible with a traditional ANR time (i.e., acoustic) domain feed forward system, which is instead based on pre-tuned coefficients. Operating in the frequency domain, the canceller 70 is not bounded by processing latencies to create a causal system. However, in an alternative approach, the canceller 70 could operate in the time domain to, e.g., minimize system complexity. Canceller 70 requires only a single internal FB microphone signal (which is the primary signal) and a single external FF microphone signal (which is the reference signal used to adapt the internal FB microphone signal), and does necessarily require any ANR system to be present.

Canceller 70 outputs a substantially low frequency signal that is passed through a delay 66 for time alignment purposes, and is then passed to a low pass filter 52 to remove any high frequency components (e.g., above 2 kHz). In certain embodiments, the result can optionally be processed by a noise suppression system (NSS) 54 and a scale 56 process before outputting a processed low frequency audio signal 74. When implemented, NSS 54 provides additional noise suppression beyond what the adaptive filter provides. Scale 56 ensures that after noise reduction, the output signal 74 is scaled to a desired level to match other output signals (e.g., signal 76) processed by the intelligent mixer 46.

In a similar manner, external signal processing system 42 may utilize an adaptive (reverse) feed forward canceller 72 similar but opposite in principal to the (forward) feed forward canceller 70. In this implementation, the canceller 72 likewise operates in the frequency (i.e., electrical) domain. However, in an alternative approach, the canceller 72 could operate in the time domain to, e.g., minimize system complexity. Canceller 72 likewise only requires a single external FF microphone signal (which is the primary signal) and a single internal FB microphone signal (which is the noise reference used to adapt the external FF microphone signal), and does necessarily require any ANR system to be present. In this case, the external FF microphone signal is first processed with a delay 64 to time align with the internal signal processing system 40.

The output of canceller 72 is passed through a high pass filter 58 to remove any low frequency components (e.g., below 2 kHz). In certain embodiments, the result is further processed by a mild NSS 60 and a scale 62 process, before outputting a processed high frequency audio signal 76. The mild NSS 60 provides a limited amount of noise suppression that is not too aggressive so as to avoid loss of speech quality.

Intelligent mixer 46 mixes the low frequency audio signal 74 and the high frequency audio signal 76, which can be done using any technique. For example, the amount of high frequency signal or low frequency signal may be determined based on predefined ratios, based on external inputs such as a noise detector or wind detector, etc. The resulting signal is then converted back to the time domain by inverse domain converter system 50 to generate an enhanced speech signal 68, which can thereafter be further processed and/or transmitted to another listener's device.

Both the internal signal processing system 40 and the external signal processing system 42 may utilize a VAD 94 that, e.g., generates a voice detection flag to facilitate adaptation of the respective filter coefficients during non-voice periods. Adapting during non-voice periods ensures that the filter coefficients only focus on cancelling the noise transmission path to the inner microphone for the low frequency audio signal 74 and on cancelling the noise transmission path to the external microphone for the high frequency audio signal 76.

Figure 3:
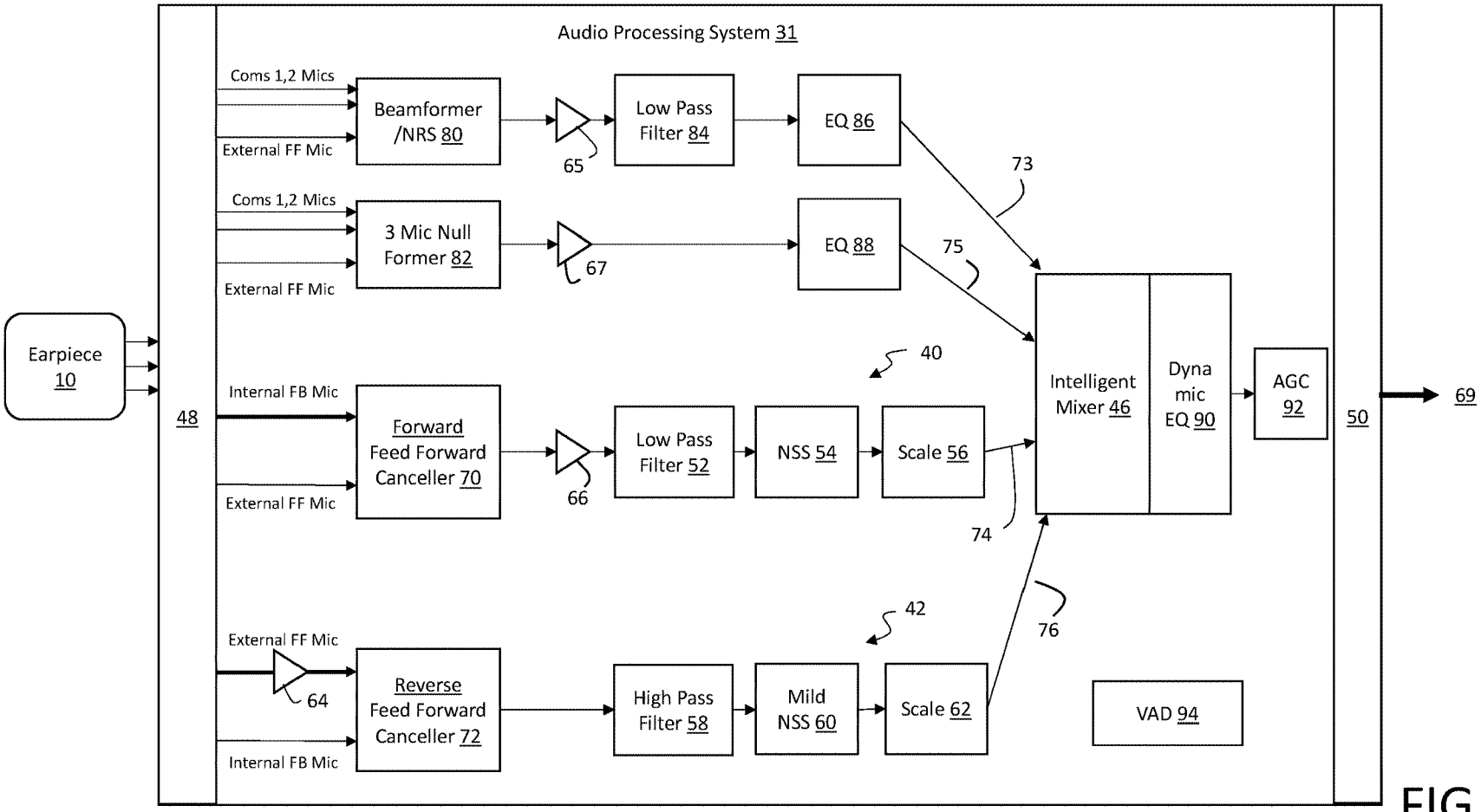
FIG. 3 is a block diagram depicting a further audio processing system according to various implementations.

FIG. 3 depicts a further implementation of an audio processing system 31, which includes two additional signal processing systems to generate an enhanced speech signal 69. Namely, system 31 includes a beamformer/noise reduction system (NRS) 80 and a three microphone (3 Mic) null former 82. Although shown with two additional signal processing systems 80, 82, it is understood that in certain implementations audio processing system 31 could include one or more additional systems 80, 82.

In certain implementations, beamformer/NRS 80 receives input from two external communication microphones (Coms 1, 2 Mics) and an external FF microphone. However it is understood that any type of external microphone array could be utilized. Beamformers that utilize external microphone arrays are known to provide good voice pick-up and audibility in environments with little or moderate external wind and noise, and for certain frequency ranges can perform well even in high noise environments. In some implementations, external microphone array processor (i.e., beamformer/NRS) 80 may include a single sided microphone-based noise reduction system that includes a minimum variance distortionless response (MVDR) beamformer, a delay and subtract process (DSUB), and an external signal adaptive canceller. In one approach, the DSUB time aligns and equalizes a set of microphones to mouth direction signals and subtracts to provide a noise correlated reference signal. Other complex array techniques could alternatively be used to minimize speech pickup in the mouth direction.

In the example shown, the output of beamformer/NRS 80 is passed through a delay 65 for time alignment purposes, then through a low pass filter 84 and an equalizer (EQ) 86. The result is a processed signal 73 that can be selectively mixed with the low and high frequency audio signals 74, 76 by intelligent mixer 46. In various embodiments, the low pass filter 84 and EQ 86 are integrated within the intelligent mixer 46, which operates on frequency based components received from the beamformer/NRS 80. Regardless, the low pass filter 84 isolates the frequency band where the external microphone based beamformer/NRS 80 operates best for mixing with other signals. EQ 86 ensures the levels are matched as a function of frequency so when mixed with other signal branches of audio processing system 31, they sound natural.

In certain implementations, at low levels of external noise (e.g., as detected by a wind sensor), the intelligent mixer 46 may favor the output signal 73 from the beamformer/NRS 80 due to the inherent superior voice quality of the external microphones. At moderate levels of external noise, a mixture of processed signal 73 with the two previously described low and high frequency audio signals 74, 76 can be used. At very high noise levels (e.g., if wind is detected), the mixer 46 may only utilize the low and high frequency audio signals 74, 76.

In further implementations, a null former, such as the depicted three microphone null former 82 may be utilized to generate an alternative or additional high frequency component, i.e., signal 75. High frequency signal 75 can be combined with the low frequency audio signal 74 either in place of or in addition to high frequency audio signal 76. In certain aspects, three microphone null former 82 utilizes an unconstrained adaptive noise canceller in which one of the external microphones (e.g., Com 1) provides the primary signal and the other external microphone (Com 2) along with the FF microphone collect noise reference signals during non-speech activity. The reference signals are applied to the primary signal for noise reduction, and the result is used to provide a high frequency signal 75. In certain embodiments, adapting is done during noise only periods, and since the microphones are close to each other, most of the noise will be canceled at the output of the null former. When speech is detected, the filter coefficients are frozen, and the speech energy filters through resulting in a higher SNR than at the input. Details of such a null former are provided in US Patent Publication 2019/0304427, entitled "ADAPTIVE NULLFORMING FOR SELECTIVE AUDIO PICK-UP," filed on Jun. 19, 2019, the contents of which is hereby incorporated by reference.

As noted, intelligent mixer 46 may use any algorithm or process to determine the best signals for the operating condition using frequency sub bands. Using sub band mixing enables alternate band mixing strategies even in the low frequencies with beamformer 80 and/or null former 82 to further improve the overall perceptual quality of the low frequency audio signal 74. In various implementations, thresholds for selecting the best mix by the mixer 64 may be based on the signal-to-noise ratio (SNR) of each output signal 73, 74, 75, 76, and thresholds can be determined as part of a tuning process. The SNR can be accurately determined using VAD 94. In some implementations, various inputs, such as detection of head movements or mobility of the user can also be used to determine the best artifact free output. In still further implementations, mixer 64 can be controlled by the user via a user control input to manually select the best setting. In one implementation, thresholds can be tuned based on user preference. In other implementations, a manual switch can be provided to allow the user to force the internal signal processing system 40 to operate during high noise or wind.

In certain implementations, a dynamic equalizer 90 and automated gain control (AGC) 92 may be utilized to further improve the speech quality of the enhanced speech signal 69.

According to various implementations, a wearable audio device provides the technical effect of enhancing voice pick-up during challenging environmental conditions, e.g., high wind or noise. In particular implementations involving in-ear devices, a low frequency component of the user's speech extracted from an internal microphone is mixed with a high frequency component of the user's speech extracted from an external microphone in order to provide an intelligible audio output.

In various implementations, the described systems and methods can work without an explicit wind detector since the low frequency inner microphone signals are naturally shielded from wind and the high frequency audio signal 76 from (reverse) feed forward canceller 72 will involve a high SNR external microphone, which is not significantly impacted by wind energy. The result allows for very good SNR for both low and high frequencies using available sensors.

It is noted that the implementations described herein are particularly useful for two way communications such as phone calls, especially when using ear buds. However, the benefits extend beyond phone call applications in that these approaches can potentially provide SNR that rival boom microphones with just a single ear bud. These technologies are also applicable to aviation and military use where high nose pick up with ear buds is desired. Further potential uses include peer-to-peer applications where the voice pickup is shielded from echo issues normally present. Other use cases may involve automobile 'car wear' like applications, wake word or other human machine voice interfaces in environments where external microphones will not work reliably, self-voice recording/analysis applications that provide discreet environments without picking up external conversations, and any application in which multiple external microphones are not feasible. Further, the implementations may be useful in work from home or call center applications by avoiding picking up nearby conversations, thus providing privacy for the user.

It is understood that one or more of the functions of the described systems may be implemented as hardware and/or software, and the various components may include communications pathways that connect components by any conventional means (e.g., hard-wired and/or wireless connection). For example, one or more non-volatile devices (e.g., centralized or distributed devices such as flash memory device(s)) can store and/or execute programs, algorithms and/or parameters for one or more described devices. Additionally, the functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions. All or part of the functions can be implemented as, special purpose logic circuitry, e.g., an FPGA (field programmable gate array) and/or an ASIC (application-specific integrated circuit). Processors suitable for the execution of a computer program include, by way of example, both general and special purpose microprocessors, and any one or more processors of any kind of digital computer. Generally, a processor may receive instructions and data from a read-only memory or a random access memory or both. Components of a computer include a processor for executing instructions and one or more memory devices for storing instructions and data.

It is noted that while the implementations described herein utilize microphone systems to collect input signals, it is understood that any type of sensor can be utilized separately or in addition to a microphone system to collect input signals, e.g., accelerometers, thermometers, optical sensors, cameras, etc.

Additionally, actions associated with implementing all or part of the functions described herein can be performed by one or more networked computing devices. Networked computing devices can be connected over a network, e.g., one or more wired and/or wireless networks such as a local area network (LAN), wide area network (WAN), personal area network (PAN), Internet-connected devices and/or networks and/or a cloud-based computing (e.g., cloud-based servers).

In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

I claim:

1. A method for processing signals for a wearable audio device, comprising:

capturing an internal signal with an inner microphone configured to be acoustically coupled to an environment inside an ear canal of a user;

extracting a low frequency audio signal from the internal signal;

capturing an external signal with an external microphone configured to be acoustically coupled to an environment outside the ear canal of the user;

extracting a high frequency audio signal from the external signal, wherein extracting the high frequency audio signal comprises filtering the external signal using parameters calculated from the internal signal; and mixing the high frequency audio signal with the low frequency audio signal.

2. The method of claim 1, wherein the parameters comprise filter coefficients.

3. The method of claim 2, wherein the filter coefficients are calculated from the internal signal during non-speech activity.

4. The method of claim 3, wherein the internal signal is captured with an internal feedback microphone.

5. The method of claim 1, wherein extracting the low frequency audio signal from the internal signal comprises using parameters calculated from the external signal to filter the internal signal.

6. The method of claim 5, wherein using parameters calculated from the external signal to filter the internal signal comprises calculating filter coefficients from the external signal during non-speech activity.

7. The method of claim 1, wherein the external signal is captured with a null former that adaptively cancels noise based on sounds captured from a further external microphone during non-speech activity.

8. The method of claim 1, wherein mixing the high frequency audio signal with the low frequency audio signal comprises:

detecting a noise level proximate the wearable audio device; and selecting a mixing strategy based on the noise level.

9. The method of claim 8, wherein the noise level is detected with at least one of a microphone or a voice activity detector.

10. The method of claim 1, further comprising using a beamformer to capture and process sounds from an array of external microphones.

11. A wearable audio device, comprising:

at least one microphone; and a processor coupled to the at least one microphone and configured to:

capture an internal signal with an inner microphone configured to be acoustically coupled to an environment inside an ear canal of a user;

extract a low frequency audio signal from the internal signal;

capture an external signal with an external microphone configured to be acoustically coupled to an environment outside the ear canal of the user;

extract a high frequency audio signal from the external signal, wherein extracting the high frequency audio signal comprises processing the external signal using parameters calculated from the internal signal; and mix the high frequency audio signal with the low frequency audio signal.

12. The device of claim 11, wherein the parameters comprise noise reduction parameters.

13. The device of claim 11, wherein the parameters are calculated from the internal signal during non-speech activity.

14. The device of claim 13, wherein the internal signal is captured with an internal feedback microphone.

15. The device of claim 11, wherein extracting the low frequency audio signal from the internal signal comprises using parameters calculated from the external signal to filter the internal signal.

16. The device of claim 15, wherein using parameters calculated from the external signal to filter the internal signal comprises calculating filter coefficients from the external signal during non-speech activity.

17. The device of claim 11, wherein the external signal is captured with a null former that adaptively cancels noise based on sounds captured from a further external microphone during non-speech activity.

18. The device of claim 11, wherein mixing the high frequency audio signal with the low frequency audio signal comprises:

detecting a noise level proximate the wearable audio device; and selecting a mixing strategy based on the noise level.

19. The device of claim 18, wherein extracting the high frequency audio signal, extracting the low frequency audio signal, and mixing the high frequency audio signal with the low frequency audio signal are processed in a frequency domain.

20. The device of claim 11, further comprising using a beamformer to capture and process sounds from an array of external microphones.

* * * * *